US005903960A

United States Patent [19]

Vrooomen

[11] Patent Number: 5,903,960

[45] Date of Patent: May 18, 1999

[54] NAPPING MACHINE

[75] Inventor: Albert Vrooomen, Monchengladbach, Germany

[73] Assignee: Sucker-Muller-Hacoba GmbH & Co., Moenchengladbach, Germany

[21] Appl. No.: 08/983,488

[22] PCT Filed: Apr. 22, 1997

[86] PCT No.: PCT/DE97/00810

§ 371 Date: Jan. 15, 1998

§ 102(e) Date: Jan. 15, 1998

[87] PCT Pub. No.: WO97/44517

PCT Pub. Date: Nov. 27, 1997

[30] Foreign Application Priority Data

May 18, 1996 [DE] Germany ..... 196 19 894

[51] Int. Cl.[6] ..... D06C 11/00

[52] U.S. Cl. ..... 26/33; 26/34

[58] Field of Search ..... 26/33, 34, 35, 26/29 R, 32, 37; 451/51, 52

[56] References Cited

FOREIGN PATENT DOCUMENTS

PS 637 249 10/1936 Germany .

PS 697 064 10/1940 Germany .

PS 801 393 1/1951 Germany .

PS 970 131 8/1958 Germany .

PS 10 78 978 10/1960 Germany .

AS 11 37 713 10/1962 Germany .

PS 213 249 12/1982 Germany .

*Primary Examiner*—Amy B. Vanatta

*Attorney, Agent, or Firm*—Kennedy Covington Lobdell & Hickman, LLP

[57] ABSTRACT

A napping device for napping a web of textile goods is described. The machine has a driven main cylinder seated in the machine frame with planetary arranged napping rollers. In order to keep one front end of the essentially cylindrical main cylinder open, but yet to assure a quiet-running seating with a long service life, the main cylinder is received at its longitudinal circumferential edges in respectively one ring-shaped ball bearing. The ball bearing comprises respectively one ball bearing shell constituting the main cylinder and one ball bearing shell fixed in place on the machine frame.

5 Claims, 1 Drawing Sheet

NAPPING MACHINE

Figure 2:
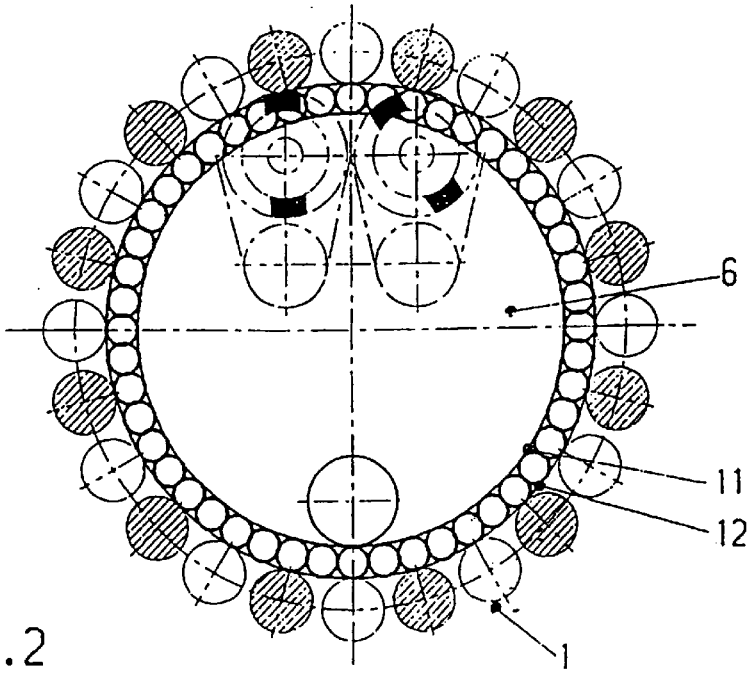

The invention relates to a napping machine, in particular a card wire napping machine, for napping at least one web of textile goods, wherein napping rollers, which are arranged in a planetary manner and driven, are seated in a driven main cylinder arrangement, sometimes referred to as a swift, which is seated in the machine frame and is cylinder-shaped in principle.

In a napping machine of this type described in DD-PS 213 249, the main cylinder is embodied by at least two round anchor plates which support the napping rollers. These round anchor plates arranged on the front or respectively the longitudinal ends of the main cylinder are each seated on at least three rollers. At least one stripping roller, arranged in a dust collecting device, should be provided inside the main cylinder. By means of this design and seating of the main cylinder it is achieved that space is created on the longitudinal sides of the main cylinder for inserting or respectively arranging an aspiration and stripping device on the interior of the main cylinder. In contrast to customary machines, such as described in DE-AS 11 37 713, the main cylinder known from DD-PS is not seated by means of spokes or the like on a main cylinder shaft, but on the rollers positioned on the inside of the main cylinder circumference or respectively of circumferences of the round anchor plates.

By means of the stripping and aspiration of the main cylinder in the main cylinder interior provided by the above mentioned DD-PS 213 249 it is achieved that, in contrast to napping machines, whose napping rollers are stripped on the outside of the main cylinder, practically the entire outer (i.e. located opposite the stripping means) circumference of the main cylinder is available for the napping process and the efficiency of the machine is correspondingly increased. However, the seating of the main cylinder on the two round anchor plates by means of the rollers is problematic. Because of the known three- or multi-point seating of the main cylinder or respectively of the round anchor plates, the noise generation of the machine becomes so great that separate sound-deadening means are required. Aside from the fact that the outlay for sound-deadening is very large, the noise generated by the machine also indicates considerable wear, so that the service life of the seating of the main cylinder or respectively its round anchor plates on the rollers is very limited.

It is the object of the invention to create a main cylinder seating which also allows a lateral access to the main cylinder interior, but assures quiet running with little noise generation and low wear.

The attainment of the object in accordance with the invention in connection with the napping machine of the type mentioned at the outset lies in that the main cylinder is received at the two longitudinal circumferential edges in respectively one ring-shaped ball bearing, one of whose ball bearing shells is a part of the main cylinder and whose other ball bearing shell is a part of the machine frame.

Accordingly, the main cylinder is constituted by elements fastened on the one ball bearing shell, which assure a reception for the napping roller seating. Preferably the exterior ball bearing shell fastened on the machine frame encloses the inner ball bearing shell fastened on the main cylinder, so that the main cylinder is actually only constituted by the elements (for the napping roller seating) fastened on the appropriate inner races of the ball bearings.

Preferably the ball bearing consisting of the two ball bearing shells including balls, rollers or the like should be designed to be ring-shaped and be of a size corresponding to the circumference of the main cylinder. In any case, the ball bearing race should have a diameter which is a multiple of former main cylinder seatings.

In accordance with the further invention, a main cylinder drive is provided on the inside of the main cylinder, which directly acts on the main cylinder, possibly on the inner ball bearing shell. Conventional driving means, for example in accordance with DE-PS 637 249, 697 064, 801 393, 970 131 and 10 78 978, can be used for the napping rollers themselves.

A main cylinder seating is created by the invention which maintains and rotatably supports the main cylinder over its entire circumference, the same as spokes supported on a conventional main cylinder shaft. By means of this a stable guidance, reduced noise generation and a correspondingly long service life are achieved. An essential advantage of the main cylinder seating in accordance with the invention lies in that service lines, which are used for stripping and aspirating the napping rollers, can be fed through one longitudinal end or both longitudinal ends or edges of the ball bearing race and the, in principle cylindrical, main cylinder.

If, as is customary, the main cylinder has different types of napping rollers, namely rollers acting with and against the nap, it is possible to provide separate stripping devices for these two roller types on the inside of the main cylinder. As is customary, stripping rollers can be arranged at each one of the roller types, aspiration can be directed to the respective stripping area or respectively the stripping roller. As with the machine in accordance with DD-PS 213 249, with the napping machine in accordance with the invention almost the entire main cylinder circumference can be used for the napping process.

Figure 1:
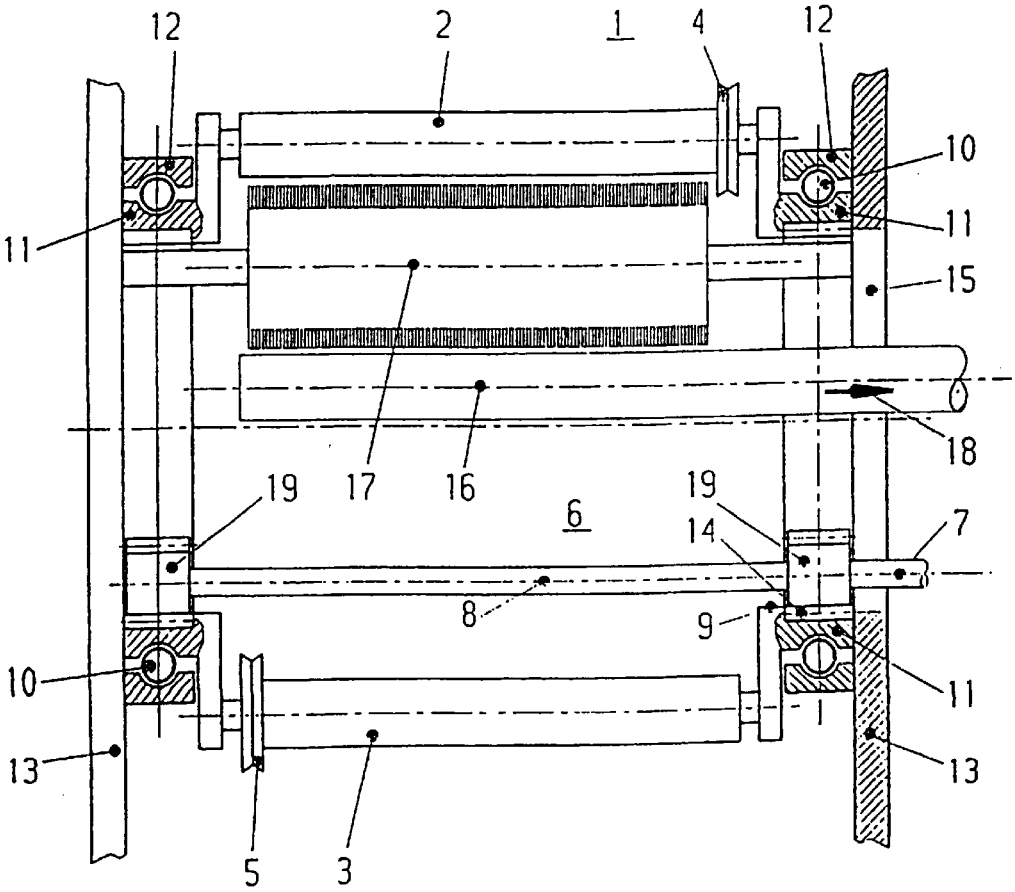

Details of the invention will be explained by means of the schematic representation of an exemplary embodiment. Shown are in:

FIG. 1, a longitudinal sectional view (parallel with the axis) of a napping main cylinder in accordance with the invention, together with the seating; and FIG. 2, a section along the line II—II of FIG. 1.

The portion of a napping machine represented in FIGS. 1 and 2 shows a main cylinder, identified as a whole by 1, a part of which are rollers 2, acting with the nap, and 3, acting against the nap. The rollers 2 acting with the nap are actuated at the one longitudinal end of the main cylinder via drive means 4, and the rollers 3 acting against the nap are actuated at the other longitudinal end of the main cylinder at the respectively required speed in the conventional manner. For example, belt, chain or gear wheel drives can be provided. The main cylinder 1 itself is put into rotation by means of a main cylinder drive device 7, which is preferably assigned to the main cylinder interior 6 and acts in an interlocked manner on a power take-off on the interior surface of the main cylinder interior via a torsion shaft 8 and in this way prevents that an angular offset of the two sides (of the main cylinder) occurs. Thus, the torsion shaft 8 is intended to assure an angle-synchronous drive of the main cylinder as a whole or respectively of the two axial longitudinal ends.

An important novelty of the machine in accordance with FIGS. 1 and 2 is the design or respectively the seating of the main cylinder 1. It is received with its two longitudinal circumferential edges 9 in respectively one ring-shaped ball bearing, identified by 10 as a whole, and is actually only constituted by elements fastened on the associated ball bearing part. The ball bearing 10 consists of a ball bearing shell which is part of the main cylinder, in particular the inner ball bearing shell 11, and a ball bearing shell, preferably an outer ball bearing shell 12, which is fastened on the machine frame 13. It is possible in principle to interchange the ball bearing shells 11, 12—if necessary with an adaptation of the drive—, i.e. the outer ball bearing shell 12 can be a part of or respectively fixed in place on the main cylinder 1 and the inner ball bearing shell 11 on the machine frame 13.

Because of the seating of the main cylinder 1, preferred by the invention, at bearing shells 11 provided on its longitudinal ends, which completely enclose its circumferential edges 9, and in bearing shells 12 which completely enclose the first bearing shells 11 (including the balls, rollers and the like), almost ideal quiet running is achieved. Gear wheels 19, for example, which engage teeth 14 (of the gear ring) can be used for the interlocked drive of the main cylinder 1.

Since the drive in accordance with the invention of the main cylinder 1 and the napping rollers 2, 3 leaves at least one front end 15 at one of the longitudinal ends of the cylindrical main cylinder open, it is possible without problems to lead at least one aspirating tube 16 out of the main cylinder interior 6 to the outside, so that with the aid of one or several stripping rollers 17 dirt, dust and fluff pieces removed from the rollers 2, 3 acting with or against the nap are to be removed away from the stripping rollers 17 and out of the machine in the flow direction 18 by at least one aspiration tube 16.

A napping device for napping a web of textile goods is described. The machine has a driven main cylinder seated in the machine frame with planetary arranged napping rollers. In order to keep one front end of the essentially cylindrical main cylinder open, but yet to assure a quiet-running seating with a long service life, the main cylinder is received at its longitudinal circumferential edges in respectively one ring-shaped ball bearing. The ball bearing comprises respectively one ball bearing shell constituting the main cylinder and one ball bearing shell fixed in place on the machine frame.

LIST OF REFERENCE NUMERALS

1=Main cylinder
2=Roller acting with the nap
3=Roller acting against the nap
4=Drive means (2)
5=Drive means (3)
6=Interior of the main cylinder
7=Drive device
8=Torsion shaft
9=Longitudinal circumferential edge (1)
10=Ball bearing
11=Inner ball bearing shell
12=Outer ball bearing shell
13=Machine frame
14=Teeth
15=Front side (1)
16=Aspirating tube
17=Stripping roller
18=Flow direction
19=Gear wheel

I claim:

1. A card wire napping machine for napping at least one web of textile goods, comprising a machine frame (13), a generally cylindrically-shaped driven main cylinder assembly (1) supported by the machine frame (13), the main cylinder assembly (1) including a planetary arrangement of plural driven napping rollers (2, 3), the main cylinder assembly (1) having circumferential edge regions (9) at opposite longitudinal ends thereof, and a ring-shaped ball bearing assembly (10) for supporting the circumferential edge regions (9), the ball bearing assembly (10) having a first ball bearing shell (11) connected with the main cylinder (1) and a second ball bearing shell (12) connected with the machine frame (13).

2. The napping machine in accordance with claim 1, wherein the diameter of the ring-shaped ball bearing (10) is approximately equal to the diameter of the main cylinder assembly.

3. The napping machine in accordance with claim 1, wherein the first ball bearing shell comprises an inner ball bearing shell (11) fastened on the main cylinder assembly (1) and the second ball bearing shell comprises an outer ball bearing shell (12) on the machine frame (13).

4. The napping machine in accordance with claim 1, further comprising a main cylinder drive device (7) including a torsion shaft (8), toothed gear wheels (19) affixed to the shaft, and a gear ring having teeth (14) which meshingly engage the toothed gear wheels (19).

5. The napping machine in accordance with claim 1, wherein the main cylinder assembly (1) defines an interior area (6), and further comprising at least one stripping roller (17) arranged in the interior area (6) of the main cylinder assembly (1) and a dust aspiration device associated with the stripping roller (17), the dust aspiration device including an aspiration tube (16) extending into the interior area (6) through a front side (15) of the main cylinder assembly (1).

* * * * *